US005533954A

United States Patent [19]

Zogg

[11] Patent Number: 5,533,954

[45] Date of Patent: Jul. 9, 1996

[54] ONE-PIECE CORRUGATED TRAY

[76] Inventor: Alan R. Zogg, R.R. #3, Box 174, Greene, N.Y. 13778

[21] Appl. No.: 330,210

[22] Filed: Oct. 27, 1994

[51] Int. Cl.[6] ..... B31B 1/178

[52] U.S. Cl. ..... 493/310; 493/355; 493/356; 493/399; 493/438; 493/442; 493/964

[58] Field of Search ..... 493/310, 355, 493/356, 354, 357, 359, 360, 397, 399, 400, 401, 402, 403, 407, 436, 408, 438, 442, 443, 964

[56] References Cited

U.S. PATENT DOCUMENTS

| | | | |
|---|---|---|---|
| 985,870 | 3/1911 | Westling | 229/120.28 |
| 1,801,998 | 4/1931 | Boeye | 229/15 |
| 2,124,808 | 7/1938 | White et al. | 229/27 |
| 2,314,491 | 3/1943 | Greenberg | 229/14 |
| 2,391,230 | 12/1945 | Dickerman | 93/37 |
| 2,995,291 | 8/1961 | Swanson et al. | 229/42 |
| 3,235,432 | 2/1966 | George | 229/939 |
| 3,362,609 | 1/1968 | Freedy | 493/356 |
| 3,559,866 | 2/1971 | Olson, Sr. | 229/14 |
| 3,978,773 | 9/1976 | Pinto | 493/438 |
| 4,792,325 | 12/1988 | Schmidtke et al. | 493/438 |
| 5,372,570 | 12/1994 | Schmidtke et al. | 493/964 |

FOREIGN PATENT DOCUMENTS

| | | |
|---|---|---|
| 1371115 | 7/1964 | France . |
| 2315439 | 1/1977 | France . |

*Primary Examiner*—Bruce M. Kisliuk
*Assistant Examiner*—Eileen P. Morgan
*Attorney, Agent, or Firm*—Bernhard P. Molldrem, Jr.

[57] ABSTRACT

A one-piece corrugated tray is formed of a blank of sheet material wherein a filler is sandwiched between an lower liner and an upper liner. The blank is slit scored transversely to define end panels, end walls, dividing walls, and floor panels between successive walls. The blank is then power rolled so that the blank is folded up ninety degrees at front slit scores and folded down one-hundred-eighty degrees at front slit scores. The resulting tray has double-thickness walls and double-thickness floors. Trays of this construction can be used for handling and shipping decorative automotive body panels and other items of manufacture that must be protected from rubbing one another or lapping over one another.

6 Claims, 3 Drawing Sheets

ONE-PIECE CORRUGATED TRAY

BACKGROUND OF THE INVENTION

This invention relates to trays or pads for shipping, storage, or intermediate handling of articles, and is more particularly concerned with trays formed of corrugated paper board or equivalent sheet materials where a filler is sandwiched between an inner liner and an outer liner. The invention relates not only to trays made of corrugated paper starting material, but also to those made of other flat sheet material where an alternative filler is used, e.g., cellulose fiber or a foamed polymer. The liners can be paper, or in some cases a plastic film or metallized plastic film. The sheet material can also be wrapped chipboard. The invention can apply to solid sheet material as well, i.e., flat sheet board without liners.

Shallow boxes and trays are often employed for carrying articles of manufacture. Trays of this type are particularly useful in shipping or handling automotive body panels or similar items which must be protected from contacting and rubbing against one another or against other items which could cause scratches, mars, or surface blemishes. The tray is required to be lightweight but substantially rigid and durable. The tray should be conveniently stored as a flat blank, and should be easily assembled when needed. Double-wall strength is desirable. The tray should be arranged to hold moldings or other articles of various widths and lengths in separate cells.

A number of corrugated trays and similar articles appear in the prior patents. George U.S. Pat. No. 3,235,432 relates to a sheet of material that is slit scored on opposite sides to allow the sheet to be folded and used as pan of a composite structure. Greenberg U.S. Pat. No. 2,314,491; White et al. U.S. Pat. No. 2,124,808; Boeye U.S. Pat. No. 1,801,998; and Westling U.S. Pat. No. 985,870 relate to various dividers and fillers in which a material such as corrugated board is folded to make a divider or packing insert. Olson U.S. Pat. No. 3,559,866 describes a carton liner formed of a fiberboard strip that is deformed with triangular projections. A plate-like article, e.g. a sheet of plate glass, can be suspended in aligned slots in larger ones of the triangular projections.

No one has provided a suitable pre-cut blank that could be folded and formed into a tray adapted for the above-mentioned role. No one has previously used slit-scoring and power rolling to produce a suitable tray of corrugated material.

OBJECTS AND SUMMARY OF THE INVENTION

Accordingly, it is an object of this invention to provide a one-piece corrugated tray of high strength and attractive appearance, and which avoids the drawbacks of the prior art.

It is another object to provide a tray that can provide full length protection and excellent cushioning for moldings so that they do not rub against each other or lap over each other during handling or shipping.

It is yet another object to provide a tray that can be employed for in-plant handling, or which can be inserted into boxes for shipping.

It is still another object to provide a tray of high strength and crush resistance that employs a series of parallel slit scores to create double-thickness wall and floor portions.

In accordance with an aspect of this invention, a tray is made from a single blank of slit scored corrugated board or other sheet material having an upper liner, a lower liner, and a filler sandwiched between the liners. The sheet material has a predetermined thickness, and the blank has opposed end edges. Parallel divider walls are formed in the blank adjacent floor portions by reverse slit scoring the sheet material at respective pairs of parallel slit lines, e.g., slit scoring the sheet material through said lower liner and sheet material but leaving the upper liner intact. The divider walls are defined between each such pair of slit lines. The floor portions are divided from the wall portions by these parallel slit lines and are defined between successive wall portions. Front slit scores are formed by slit scoring the sheet material through the upper liner and filler but leaving the lower liner intact at respective score lines midway between the parallel slit lines. When the blank is power rolled, the sheet material is folded upwards at the reverse slit scores and is folded downwards at the front slit scores to form double thickness divider walls with the floor portions extending between successive ones of the double thickness walls.

End walls are formed by first slit scoring the blank of sheet material at a first slit line, i.e., cutting through the upper liner and filler but leaving the lower liner intact. The first slit line is spaced from a respective edge of the blank. A similar front slit score is formed at a second slit line spaced from the first slit line at a position away from the edge. An end panel is defined between the first slit line and the associated edge. Then the sheet material is reverse slit scored at a third slit line, i.e. , cut through the lower liner and filler but leaving the upper liner intact. The third slit line is spaced from the second slit line on the side remote from the associated edge. The blank is power rolled, folding the blank upwards at the third slit lines and downwards at the second slit lines to form double thickness end walls. The blank is folded downwards at the first slit lines such that the end panels lie beneath and reinforce the floor panels. A hot melt glue or other suitable adhesive is applied, e.g., on the lower liner between the floor portions and the end panels.

This construction is straightforward and rugged, and is well suited for transport and handling of decorative panels and other products which must be protected against damage. The construction can be employed for trays of any desired length or width. In the case of corrugated trays, the entire product can be recycled in a paper processing facility, thus making the product as environmentally gentle as possible.

The above and many other objects, features, and advantages of this invention will become apparent from the ensuing description of a preferred embodiment, to be read in connection with the accompanying Drawing.

DETAILED DESCRIPTION OF THE PREFERRED EMBODIMENT

Figure 1:
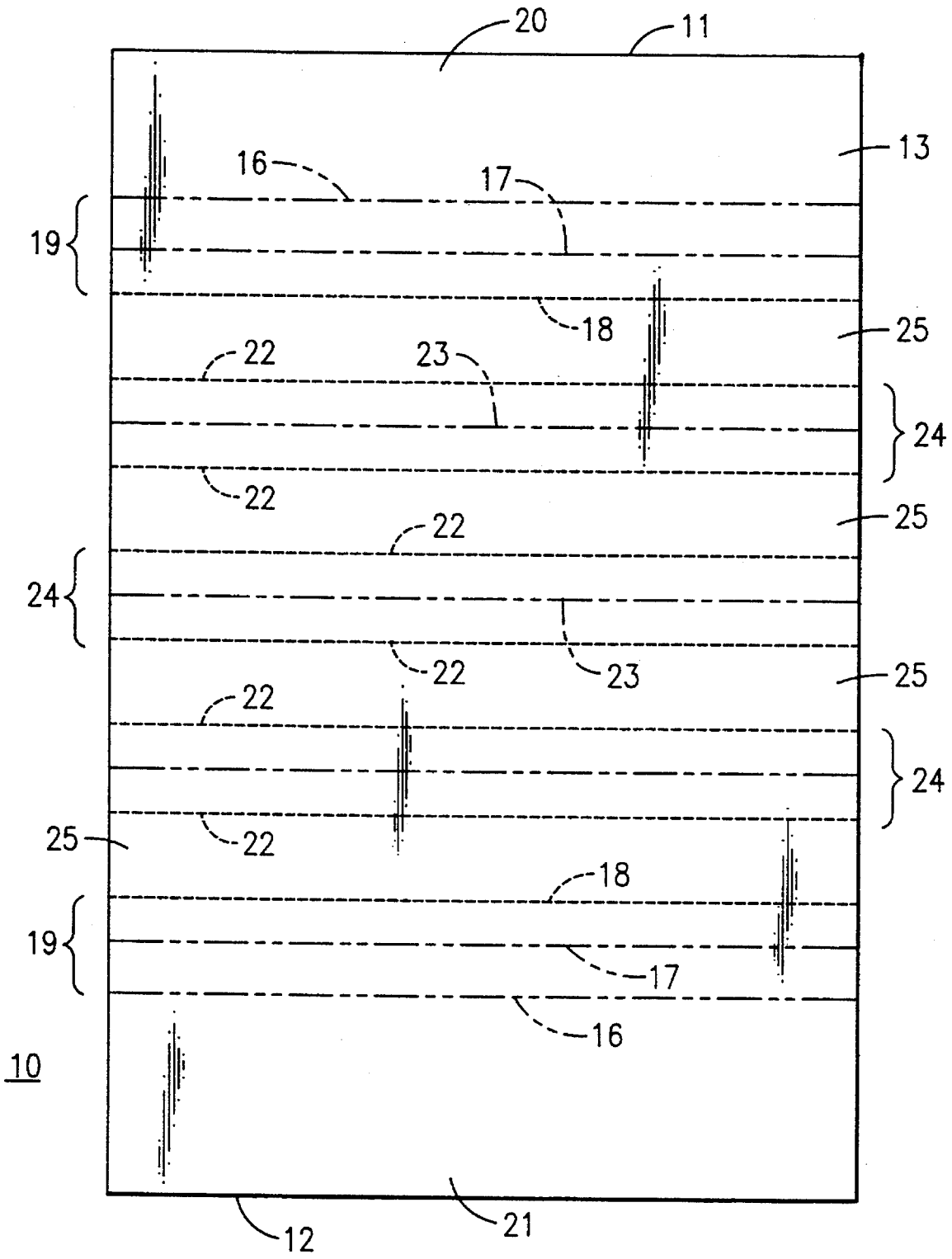
FIG. 1 is a plan view of a pre slit-scored blank of corrugated sheet, for constructing a tray according to one embodiment of this invention.
Figure 2:
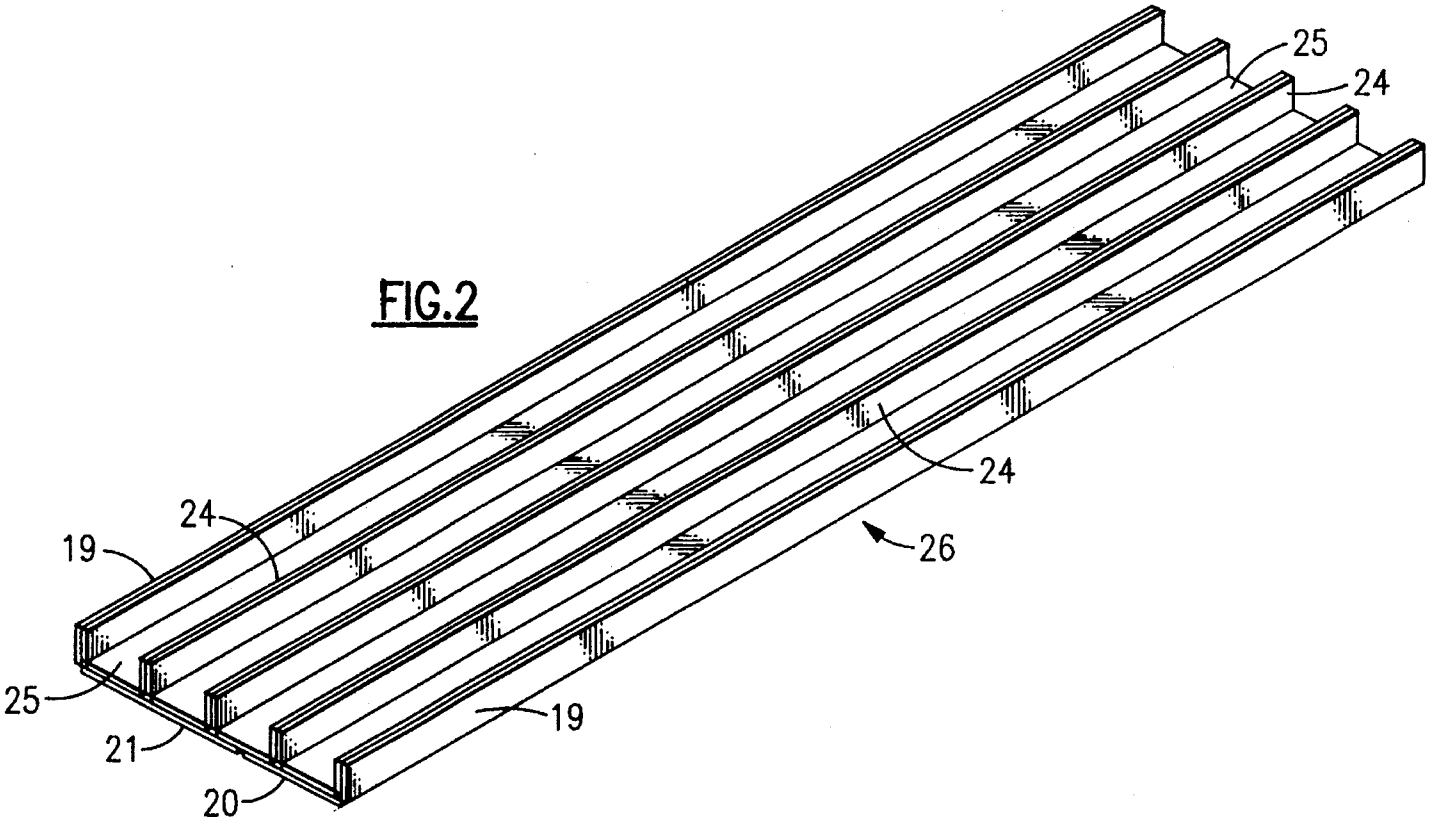
FIG. 2 is a perspective view of the tray of this embodiment.

With reference to the Drawing, and initially to FIGS. 1 and 2 thereof, a shallow box or tray according to an embodiment of this invention, and a method of constructing it, involve a rectangular blank 10 of sheet material of about one-eighth inch thickness. The blank 10 has a first edge 11 and an opposite second edge 12.

Figure 4:
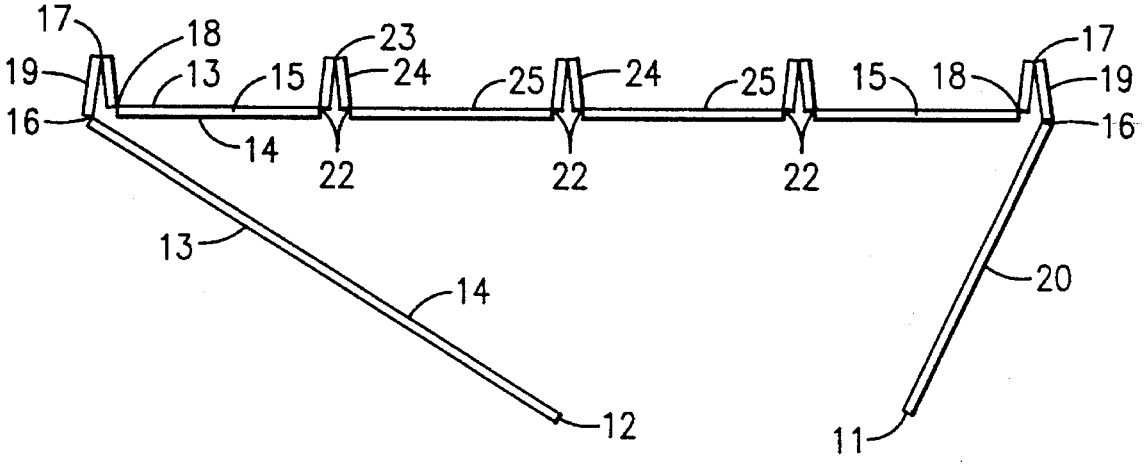
FIGS. 4, 5, and 6 are cross-sectional elevations that show steps of folding the blank to form the corrugated tray of this embodiment.

As shown in more detail in the cross-sectional elevation of FIG. 4, the blank material has a lower or inner liner 14 which is a sheet of paper optionally having a suitable coating, a filler 15 of corrugated paper or other suitable material (such as plastic foam), and an upper or outer liner 13 of paper. The filler 15 is sandwiched between the two liners 14, 13.

As shown in the plan view of FIG. 1, the blank is transversely slit scored, with the sheet material being slit or cut through one of the liners and the filler 15, leaving the other liner intact. In this plan view, the front slit scores, i.e., cut through the upper liner 13 and filler, are shown in chain lines (series of two short dashes and one long dash) and the reverse slit scores, i.e., cut through the lower liner 14 and filler 15, are shown in dash lines. Front slit scores 16, 16 are formed at transverse score lines spaced in from each of the respective ends 11 and 12. Second front slit scores 17, 17 are cut at score lines parallel to the slit scores 16, 16, and reverse slit scores 18, 18 are disposed parallel to the slit scores 16, 17 and spaced a predetermined distance on the side of the slit scores 18, 18 away from the respective edges 11, 12. End wall portions 19, 19 are defined by the sets of slit scores 16, 17, 18, and first and second end panels 20 and 21 are defined between the slit scores 16 and the respective edges 11 and 12 of the blank.

Figure 3:
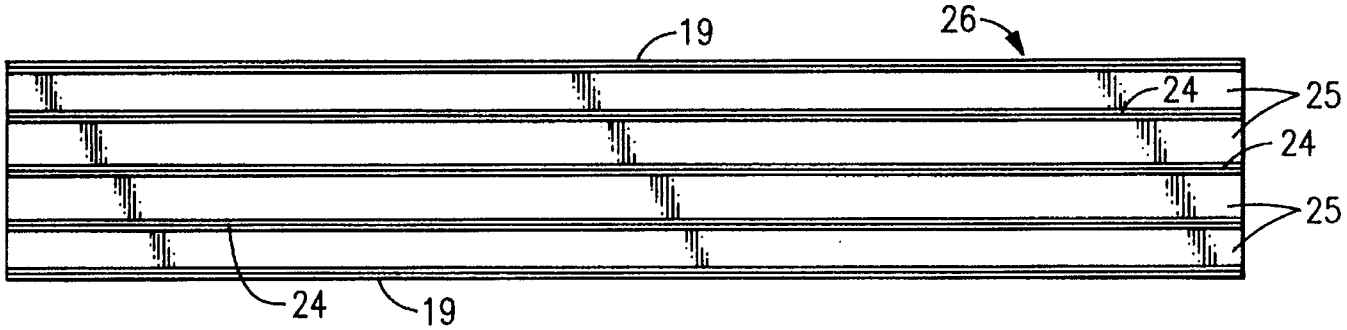
FIG. 3 is a plan view of the tray of this embodiment.

As also shown on FIG. 1, there are successive pairs of transverse reverse slit scores 22,22 spaced at intervals between the end wall portions 19, 19 with front slit scores 23 cut midway between the slit scores 22, 22 of each pair. Each pair of reverse slit scores 22, 22 with its associated front slit score 23 defines a divider wall portion 24, and floor panels 25 are defined between successive ones of the divider wall portions 24 and between each of the end wall portions 19 and the adjacent divider wall portion 24. In this embodiment, there are two end wall portions 19 and three divider wall portions 24, forming four separate cells within the tray. A finished tray 26 is shown in perspective in FIG. 2 and in plan in FIG. 3, with the blank being folded or rolled at the slit scores to form the walls 19, 24, with the floor panels separating these walls from one another.

Figure 5:
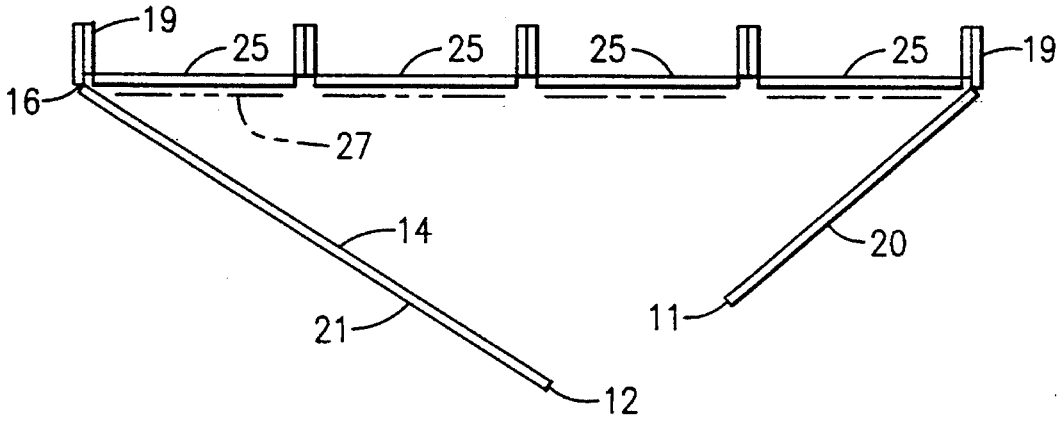
Figure 6:
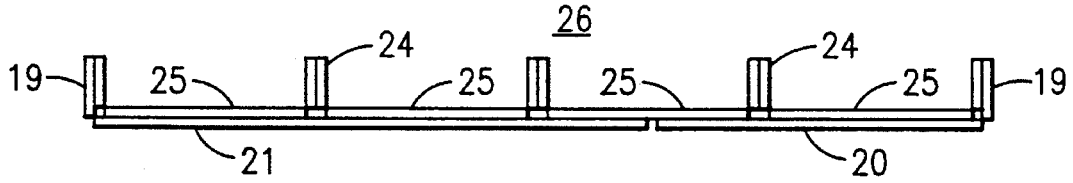

The sequence in folding or bending the blank 10 to form the completed tray 26 is shown in FIGS. 4, 5, and 6.

A bonding agent 27, such as a hot melt glue, can be applied onto the lower liner 14 beneath the floor panels 25 or beneath the end panels 20, 21.

The blank 10 is bent upwards ninety degrees, by a power roller, at the slit scores 18 and then is bent downwards one-hundred-eighty degrees at the slit scores 17 so that the end wall portions 19 projects upwards, as shown in FIG. 4. The divider wall portion s 24 are bent upwards at the slit scores 22 and are bent downwards one-hundred-eighty degrees at the slit scores 23. This forms double thickness end walls 19 and divider walls 24, as shown in FIG. 5. The bonding agent 27 can be applied to the lower liner 14 between the floor panels 25 and the end panels 20, 21, as shown in FIG. 5. Then the end panels 20, 21 are power rolled against the floor panels 25 to form the completed corrugated tray as shown in cross-section in FIG. 6. This produces a floor of two thicknesses of the corrugated sheet material. The lower liner is concealed in the completed tray 26. The tray blank 10 can be slit scored and power rolled at one station, if desired. Alternatively, the pre-slit scored tray blanks can be stored fiat, and folded when needed into the completed trays 26.

In the illustrated embodiment, the blank is formed of one-eighth inch thick corrugated board, so that the walls and floors in the completed tray 26 are one-quarter inch thick. In this embodiment, the walls 19, 24 are five-eighths inch high, but the wall height can be selected as desired for a given application. The width of the floor panels, i.e., the space between successive walls, can be selected as appropriate for a particular application. In the illustrated embodiment, this width can be, e.g., two and one-half inches.

The wall portions 19 and 24 are of double thickness and have excellent stiffness. The tray provides excellent protection for decorative trim parts during either handling or shipping. The tray can be used for set-up and assembly operations, or can be inserted into a box or carton as a divider. The tray can be made of alternative materials, such as foam-core board or solid fiberboard, rather than corrugated board. Additionally, the upper liner 13 which may be in contact with decorative trim workpieces, can include a cushioning coating, if desired.

While this invention has been described with reference to a preferred embodiment, it should be appreciated that the invention is not limited to that precise embodiment. Rather, many modifications and variations will present themselves to persons skilled in the art without departing from the scope and spirit of this invention, as defined in the appended claims.

I claim:

1. Method of forming a tray from a single blank of sheet material having an upper liner, a lower liner, and a filler sandwiched between said liners, and said sheet material having a predetermined thickness, and said blank having an end edge; the method comprising the steps of:

forming at least one divider wall adjacent a floor portion by slit scoring said sheet material through said lower liner and said sheet material but leaving said upper liner intact at two parallel slit lines with said divider wall being defined therebetween and said floor portion being separated by said parallel slit lines from said wall portion; slit scoring said sheet material through said upper liner and said filler but leaving said lower liner intact at a slit score line midway between said parallel slit lines;

folding said blank upwards at said parallel slit lines and folding said blank downwards at said slit score line to form a double thickness wall with said floor portion extending from each side thereof;

forming at least one end wall by slit scoring said sheet material through said upper liner and said filler but leaving said lower liner intact at a first slit line spaced from said end edge and at a second slit line spaced from said first slit line on a position remote from said end edge; slit scoring said sheet material through said lower liner and said filler but leaving said upper liner intact at a third slit line spaced from said second slit line on the side remote from said end edge; and folding said blank upwards at said third slit line and downwards at said second slit line to form a double thickness wall as said end wall and then folding said blank downwards at said first slit line such that said end panel lies beneath and reinforces said floor portion.

2. Method of forming a tray from a single blank of sheet material having an upper liner, a lower liner, and a filler sandwiched between said liners, said sheet material having a predetermined thickness; the method comprising the steps of:

forming at least one divider wall adjacent a floor portion by slit scoring said sheet material through said lower liner and said sheet material but leaving said upper liner intact at two parallel slit lines with said divider wall being defined therebetween and said floor portion being separated by said parallel slit lines from said wall portion; slit scoring said sheet material through said upper liner and said filler but leaving said lower liner intact at a score line midway between said parallel slit lines;

applying a bonding agent onto said lower liner in said divider wall; and folding said blank upwards at said parallel slit lines and folding said blank downwards at said score line to form a double thickness wall with said floor portion extending from each side thereof.

3. Method of forming a tray from a single blank of sheet material having an upper liner, a lower liner, and a filler sandwiched between said liners, and said sheet material having a predetermined thickness, and said blank having an end edge; the method comprising the steps of:

forming a plurality of parallel divider walls adjacent a floor portion by slit scoring said sheet material through said lower liner and said sheet material but leaving said upper liner intact at respective pairs of parallel slit lines with said divider walls being defined between each said pair, and said floor portion being separated by said parallel slit lines from said wall portions; slit scoring said sheet material through said upper liner and said filler but leaving said lower liner intact at respective slit score lines midway between said parallel slit lines;

applying a bonding agent onto said lower liner in said divider walls; and folding said blank upwards at said parallel slit lines and folding said blank downwards at said slit score lines to form double thickness walls with said floor portion extending between successive ones of said double thickness walls.

4. The method of forming a tray from a single blank of sheet material having an upper liner, a lower liner, and a filler sandwiched between said liners, and said sheet material having a predetermined thickness, and said blank having an end edge; the method comprising the steps of:

forming a plurality of parallel divider walls adjacent a floor portion by slit scoring said sheet material through said lower liner and said sheet material but leaving said upper liner intact at respective pairs of parallel slit lines with said divider walls being defined between each said pair, and said floor portion being separated by said parallel slit lines from said wall portions: slit scoring said sheet material through said upper liner and said filler but leaving said lower liner intact at respective slit score lines midway between said parallel slit lines; and folding said blank upwards at said parallel slit lines and folding said blank downwards at said slit score lines to form double thickness walls with said floor portion extending between successive ones of said double thickness walls; and further comprising forming a pair of end walls by slit scoring said sheet material through said upper liner and said filler but leaving said lower liner intact at a first slit line spaced from a respective one of said edges and at a second slit line spaced from said first slit line at a position remote from said edge, with an end panel being defined between said first slit line and the associated edge; slit scoring said sheet material through said lower liner and said filler but leaving said upper liner intact at a third slit line spaced from said second slit line on the side remote from said edge; and folding said blank upwards at said third slit lines and downwards at said second slit lines to form double thickness end walls as said end walls and then folding said blank downwards at said first slit lines such that said end panels lie beneath and reinforce said floor portions at positions midway between the slit scores of each of said plurality of pairs of slit scores.

5. Method of forming a tray from a single blank of sheet material having an upper side and a lower, said sheet material having a predetermined thickness, and said blank having an end edge; the method comprising the steps of:

forming at least one divider wall adjacent a floor portion by slit scoring said sheet material through said lower side but leaving said upper side intact at two parallel slit lines with said divider wall being defined therebetween and said floor portion being separated by said parallel slit lines from said wall portion; slit scoring said sheet material through said upper but leaving said lower side intact at a slit score line midway between said parallel slit lines;

folding said blank upwards at said parallel slit lines and folding said blank downwards at said slit score line to form a double thickness wall with said floor portion extending from each side thereof;

forming at least one end wall by slit scoring said sheet material through said upper side but leaving said lower side intact at a first slit line spaced from said end edge and at a second slit line spaced from said first slit line on a position remote from said end edge; slit scoring said sheet material through said lower side but leaving said upper side intact at a third slit line spaced from said second slit line on the side remote from said end edge; and folding said blank upwards at said third slit line and downwards at said second slit line to form a double thickness wall as said end wail and then folding said blank downwards at said first slit line such that said end panel lies beneath and reinforces said floor portion.

6. Method of forming a tray from a single blank of sheet material having an upper side and a lower side, said sheet material having a predetermined thickness; the method comprising the steps of:

forming at least one divider wall adjacent a floor portion by slit scoring said sheet material through said lower side but leaving said upper side intact at two parallel slit lines with said divider wall being defined therebetween and said floor portion being separated by said parallel slit lines from said wall portion; slit scoring said sheet material through said upper side but leaving said lower side intact at a score line midway between said parallel slit lines;

applying a bonding agent onto said lower side in said divider wall; and folding said blank upwards at said parallel slit lines and folding said blank downwards at said score line to form a double thickness wall with said floor portion extending from each side thereof.

* * * * *